US009309741B2

(12) United States Patent
Kosakewich

(10) Patent No.: US 9,309,741 B2
(45) Date of Patent: Apr. 12, 2016

(54) SYSTEM AND METHOD FOR TEMPORARILY SEALING A BORE HOLE

(71) Applicant: Triple D Technologies Inc., Edmonton (CA)

(72) Inventor: Darrell S. Kosakewich, Camrose (CA)

(73) Assignee: Triple D Technologies, Inc., Edmonton, AB (CA)

( * ) Notice: Subject to any disclaimer, the term of this patent is extended or adjusted under 35 U.S.C. 154(b) by 461 days.

(21) Appl. No.: 13/762,931

(22) Filed: Feb. 8, 2013

(65) Prior Publication Data

US 2014/0224488 A1 Aug. 14, 2014

(51) Int. Cl.

| | |
|---|---|
| ***E21B 36/00*** | (2006.01) |
| ***E21B 33/124*** | (2006.01) |
| ***E21B 33/12*** | (2006.01) |
| ***E21B 43/26*** | (2006.01) |

(52) U.S. Cl.

CPC ..... *E21B 33/1208* (2013.01); *E21B 36/001* (2013.01); *E21B 43/26* (2013.01); *E21B 33/124* (2013.01)

(58) Field of Classification Search

CPC ... E21B 36/001; E21B 33/12; E21B 33/1208; E21B 33/124

See application file for complete search history.

(56) References Cited

U.S. PATENT DOCUMENTS

| | | | | |
|---|---|---|---|---|
| 1,342,780 | A | 6/1920 | Vedder | |
| 3,194,315 | A * | 7/1965 | Rogers | 166/57 |
| 3,301,326 | A | 1/1967 | Mcnamer et al. | |
| 3,424,662 | A | 1/1969 | Hudgins | |
| 3,439,744 | A | 4/1969 | Bradley | |
| 3,500,930 | A | 3/1970 | Bradley | |
| 3,559,737 | A | 2/1971 | Ralstin | |
| 3,602,310 | A | 8/1971 | Halbert | |
| 3,720,065 | A | 3/1973 | Sherard | |
| 3,759,329 | A | 9/1973 | Ross | |
| 3,766,985 | A * | 10/1973 | Willhite | 166/302 |
| 3,882,937 | A | 5/1975 | Robinson | |
| 3,943,722 | A | 3/1976 | Ross | |

(Continued)

FOREIGN PATENT DOCUMENTS

| | | |
|---|---|---|
| CA | 2588297 | 11/2007 |
| SU | 588289 A1 | 1/1978 |
| WO | WO 2008/048451 | 4/2008 |

OTHER PUBLICATIONS

International Search Report and Written Opinion for Application No. PCT/IB2013/000586, dated Oct. 16, 2013, 8 pages.

(Continued)

*Primary Examiner* — Kenneth L Thompson

(74) *Attorney, Agent, or Firm* — Dawn-Marie Bey; Bey & Cotropia PLLC

(57) ABSTRACT

A production zone isolation system includes a sealing mechanism is positioned adjacent to or within the production zone of a well bore such that the expanders are positioned parallel to areas aft and fore of the area which is to be isolated. A refrigerant or cooling agent is pumped into a first inner tubular and exits out of the expanders and into regions of second outer tubular. At pressurized water filled regions of the well bore that are adjacent to the regions of the second outer tubular, freezing is induced, thereby forming ice plugs and a sealed region therebetween. The refrigerant is not in direct contact with the surrounding water but is instead in juxtaposition to it and separated therefrom by second outer tubular.

7 Claims, 3 Drawing Sheets

(56) References Cited

U.S. PATENT DOCUMENTS

| | | | | |
|---|---|---|---|---|
| 3,978,921 | A | 9/1976 | Ross | |
| 4,030,547 | A | 6/1977 | Ross | |
| 4,124,253 | A | 11/1978 | Latiolais et al. | |
| 4,125,159 | A * | 11/1978 | Vann | 166/285 |
| 4,424,858 | A | 1/1984 | Elliott et al. | |
| 4,474,238 | A | 10/1984 | Gentry et al. | |
| 5,097,903 | A | 3/1992 | Wilensky | |
| 5,294,261 | A | 3/1994 | McDermott et al. | |
| 5,507,149 | A | 4/1996 | Dash et al. | |
| 5,653,287 | A | 8/1997 | Wilson et al. | |
| 5,661,233 | A | 8/1997 | Spates et al. | |
| 5,829,519 | A | 11/1998 | Uthe | |
| 5,836,393 | A | 11/1998 | Johnson | |
| 6,209,633 | B1 | 4/2001 | Haynes | |
| 6,929,068 | B2 | 8/2005 | Chitty | |
| 7,438,501 | B2 | 10/2008 | Sopko | |
| 7,516,787 | B2 * | 4/2009 | Kaminsky | 166/250.1 |
| 7,775,281 | B2 | 8/2010 | Kosakewich | |
| 8,448,708 | B2 * | 5/2013 | Kosakewich | 166/302 |
| 2005/0121396 | A1 | 6/2005 | Kosakewich | |
| 2007/0095537 | A1 | 5/2007 | Vinegar | |
| 2008/0035345 | A1 | 2/2008 | Kosakewich | |
| 2009/0101348 | A1 | 4/2009 | Kaminsky | |
| 2010/0263869 | A1 | 10/2010 | Kosakewich | |
| 2010/0263874 | A1 | 10/2010 | Kosakewich | |

OTHER PUBLICATIONS

International Search Report for PCT Application No. PCT/IB2013/000636, dated Sep. 24, 2013, 3 pages.

Written Opinion for PCT Application No. PCT/IB2013/000636, dated Sep. 24, 2013. 5 pages.

Specifications and Claims for U.S. Appl. No. 13/759,301, filed Feb. 5, 2013.

* cited by examiner

SYSTEM AND METHOD FOR TEMPORARILY SEALING A BORE HOLE

FIELD OF THE EMBODIMENTS

The embodiments relate in general to systems and methods for temporarily sealing a bore hole. More particularly, the embodiments are directed to a system and resulting method that temporarily seals at least a portion of bore hole to prevent incursion or excursion of gas or liquid therefrom.

BACKGROUND OF THE EMBODIMENTS

Multistage fracturing and effective isolation during stimulation is critical to the successful and efficient mining of resources. Further, effective isolation is needed for water shut-off. Existing isolation methods include, for example, cementing, which has limited effectiveness in horizontal wells due to leak-off during the cementing operation or while the cement is setting up and can be detrimental or even catastrophic to establishing isolation. Also, while cementing may be more effective in a vertical well, it may not be optimal for wells having a liner. Further, it is known that refracturing can be an effective resource recovery practice, e.g., over long time intervals In some cases, refracturing has been done three to four times during the life of a vertical producing well, however this is not possible in horizontal wells where you have only one chance with conventional state of the art hydraulic fracturing. Wells with poor cement jobs will make restimulation of specific intervals nearly impossible.

Another known isolation method includes the placement of packers on either side of an isolation location or in some cases multiple locations at the same time. A hydraulic-set mechanical packer such as the RockSeal II can provide differential pressure ratings in a variety of downhole environments. An exemplary hydraulic-set mechanical packer includes two solid hydro-mechanical rubber sealing elements that are hydraulically set on either side of a fracture to create a seal. Similarly, reactive element packers (REPs), e.g., swellable water and oil packers, have also been used as isolation or compartmentalization devices. Generally swellable packers are affixed (pre-swell) to the outside of pipe which is run into the well and are able to increase in size due reaction with one or more fluids in the well bore over an extended period of time. Mechanical packers may provide an advantage over cement due to the ability to remove the packers for secondary recovery and refracturing operations. But mechanical packers, even REPs, are limited in their ability to create a perfect seal due to the imperfect contours of the well bore walls. Further, hydraulic-set mechanical packers include moving parts, which introduced inefficiencies and the possibility for breakdown into the system.

Accordingly, there is a need in the art for an improved system and method for effectively isolating sections of a wellbore.

SUMMARY OF THE EMBODIMENTS

In a first embodiment, a system for isolating one or more water flooded sections of a well bore is described. The system includes: an outer tubular and an inner tubular having, an annulus formed therebetween and forming a closed system, an external surface of the outer tubular facing the one or more sections of the well bore, the inner tubular having at least a first plurality of perforations formed along a first portion thereof; and a pump for supplying a cooling agent at a first end of the inner tubular, wherein during operation of the pump the cooling agent exits the inner tubular through the at least a first plurality of perforations, enters the annulus and causes water located between the external surface of the outer tubular and a wall of the well bore to freeze and form an ice plug, thereby isolating the one or more flooded sections of the well bore from other sections of the well bore.

In a second embodiment, a method for isolating one or more water flooded sections of a well bore is described. The method includes: introducing a closed refrigeration system into the well bore, the closed refrigeration system including an outer tubular and an inner tubular having an annulus formed therebetween, wherein the inner tubular includes at least a first plurality of perforations formed along a first portion thereof; aligning the closed refrigeration system with one or more water flooded sections of the well bore, such that the at least a first plurality of perforations are located fore or aft of the one or more water flooded sections; introducing a cooling agent into a first end of the inner tubular, wherein the cooling agent exits the inner tubular through the at least a first plurality of perforations, enters the annulus and causes water located between an external surface of the outer tubular and a wall of the one or more water flooded sections of the well bore to freeze and form an ice plug, thereby isolating the one or more flooded sections of the well bore from other sections of the well bore.

In a third embodiment, a system for treating a well bore to access and control hydrocarbon retrieval is described. The system includes: a first set of tubulars for implementing a process for stimulating one or more fractures in a wall of one or more sections of the well bore; and a second set of tubulars for implementing a process for isolating the one or more sections of the well bore from other sections of the well bore.

DETAILED DESCRIPTION

Figure 1:
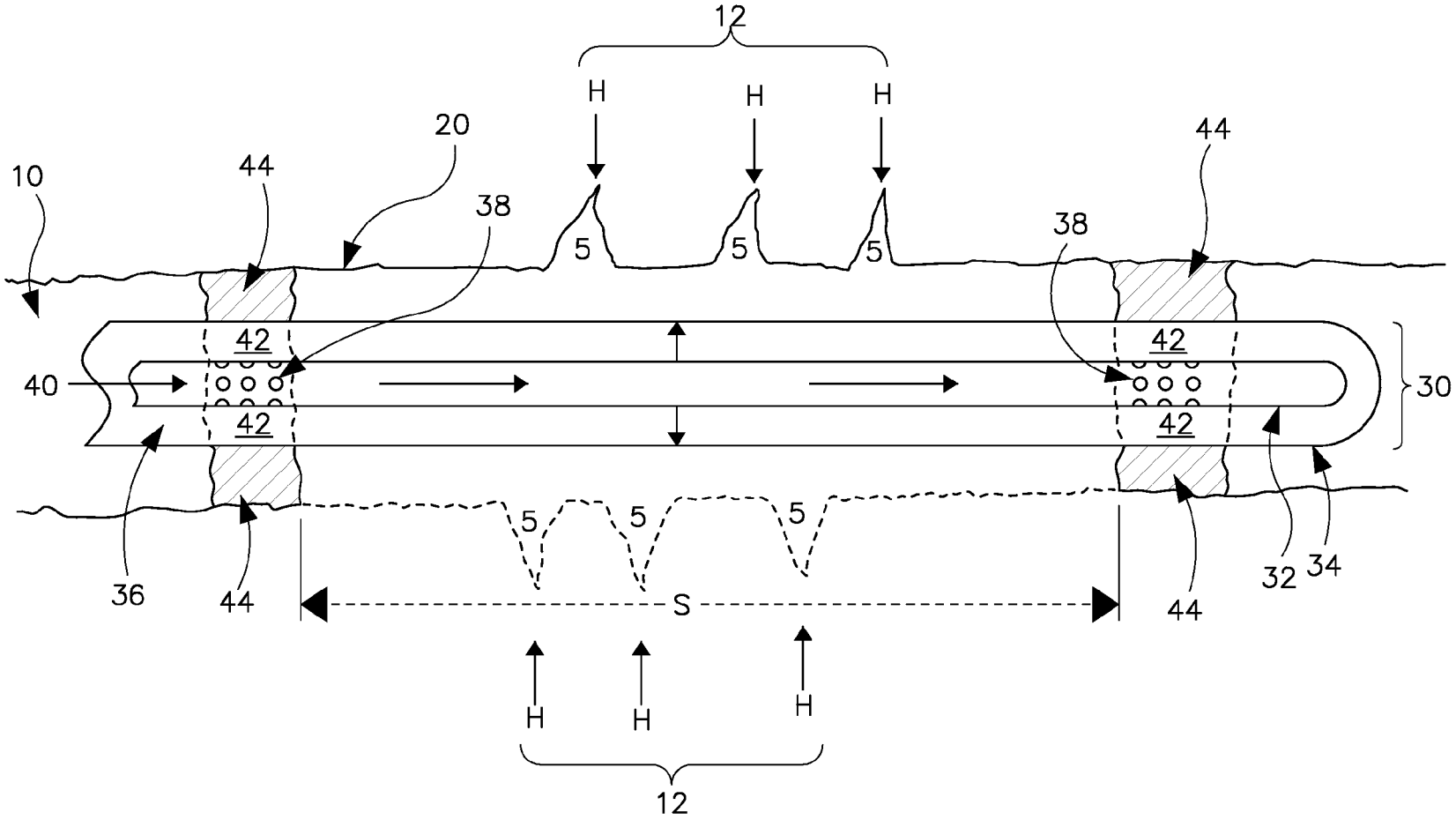
FIG. 1 illustrates a first exemplary production zone isolation system in accordance with an embodiment described herein.

Referring to FIG. 1, a first exemplary embodiment is shown. As illustrated, a representative section of a well 10 drilled into a hydrocarbon-bearing subsurface formation 20 is shown. FIG. 1 illustrates a production zone(s) 12 (i.e., the portion of well 10 that penetrates formation 20) to allow hydrocarbons H to flow from formation 20 into well 10. In FIG. 1, the well 10 is unlined and hydrocarbons can flow directly into well 10 from cracks or fissures 5 in the subsurface 20. When well 10 is producing, formation fluids comprising liquid and/or gaseous hydrocarbons H are conveyed to the surface through a string of production tubulars (not shown) which is disposed within well 10 down to the production zone.

As discussed briefly in the Background of the Embodiments, there are situations where it is necessary or desired for one or more production zones 12 to be sealed off in order to isolate or temporarily seal the production zone or zones 12 from its local surroundings, i.e.; to prevent excursion or incursion of a gas or liquid from/to the production zone 12. The present embodiments are used in water filled bore holes. Such water may be externally introduced or may be pre-existing in the well 10. FIG. 1 illustrates and exemplary sealing mechanism. The sealing mechanism is a refrigeration system 30 which is introduced into the well 10 and aligned with the production zone 12 by a crane or rig (not shown, but known to those skilled in the art) and includes first and second concentric tubulars 32, 34 for circulating a liquid or gas refrigerant therethrough. As shown, the first inner tubular 32 has a smaller diameter than second outer tubular 34 and is fitted therein, creating an annulus 36 therebetween. Additionally, the first tubular 32 includes areas of expanders 38, which are perforations in the first tubular 32. The sealing mechanism system 30 is a closed system.

In operation, the sealing mechanism is positioned adjacent to or within the production zone 12 (or portion thereof) which needs to be sealed off such that the expanders 38 are positioned parallel to areas aft and fore of the area which is to be isolated. A refrigerant or cooling agent 40, e.g., liquid nitrogen, liquid carbon dioxide, calcium chloride brine, or, preferably, liquid propane, is pumped into the first inner tubular and exits out of the expanders 38 and into regions 42 of second outer tubular 34. At the pressurized water filled regions of the well 10 that are adjacent to the regions 42 of the second outer tubular 34, freezing is induced, thereby forming ice plugs 44 and a sealed region S therebetween. As shown, the refrigerant 40 is not in direct contact with the surrounding water but is instead in juxtaposition to it and separated therefrom by second outer tubular 34. The ice plugs 44 (and 45 as described with reference to FIG. 3) are superior to any mechanical or other known seal due to the pervasive diffusion attribute of water and the further attribute of expansion upon freezing.

Figure 2:
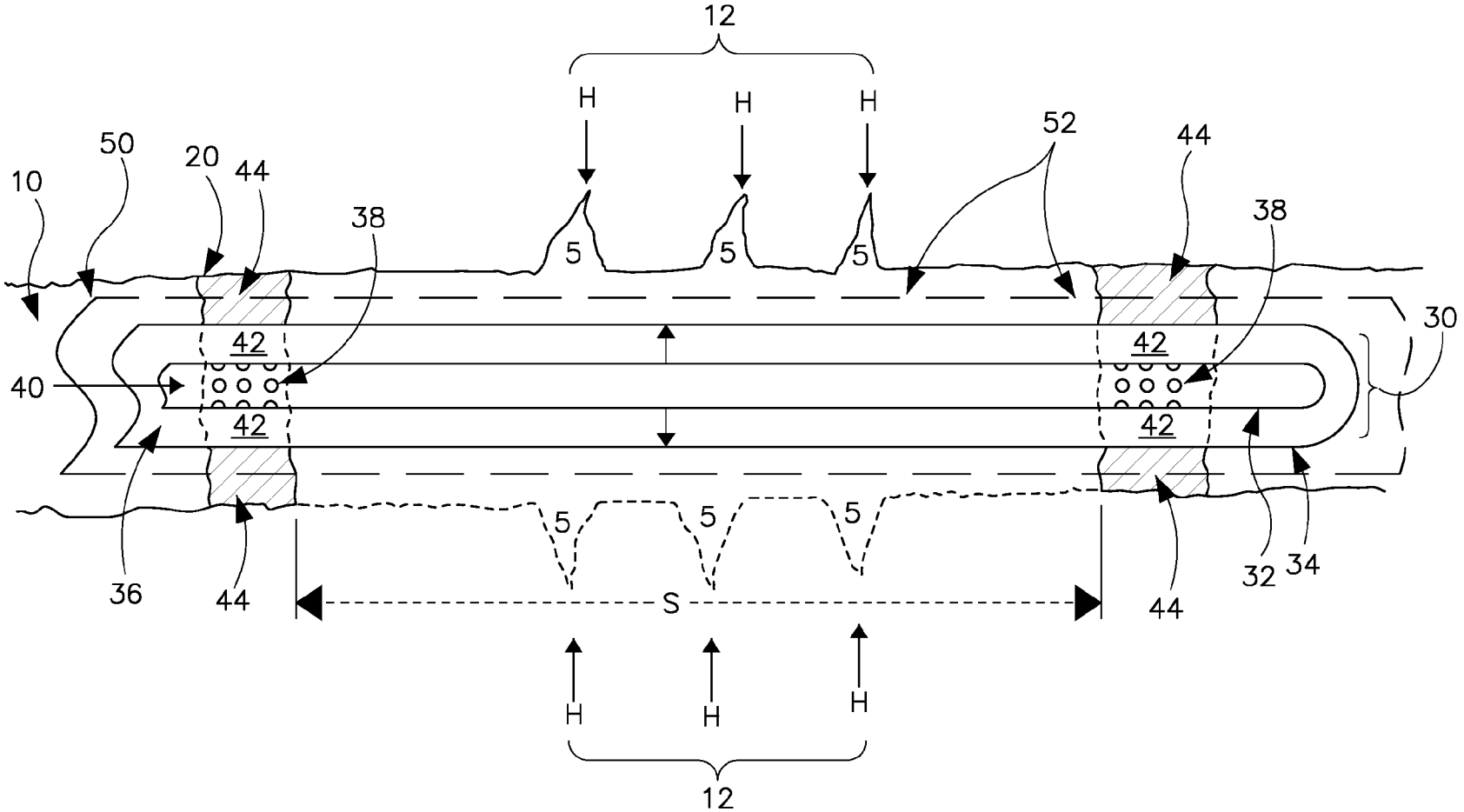
FIG. 2 illustrates a second exemplary production zone isolation system in accordance with an embodiment described herein.

FIG. 2 illustrates a second exemplary embodiment which is operated as described with respect to FIG. 1, but is slightly different in structure in that well 10 includes a well liner 50, with perforations (or slots) 52 therein. In this embodiment, the ice plugs 44 are formed through the perforations 52 of the well liner 50. Accordingly, the sealing mechanism works equally well with a lined and unlined wells.

Figure 3:
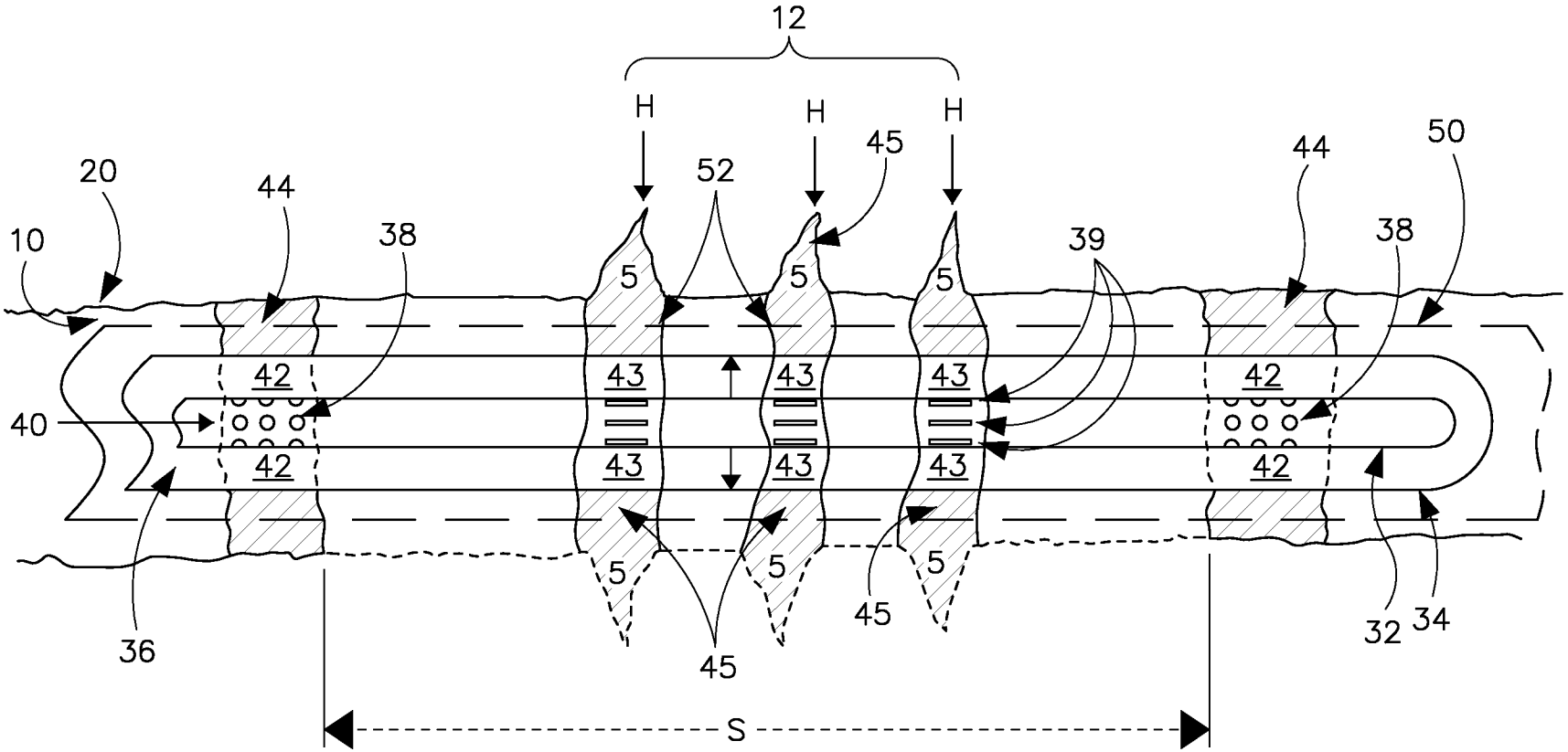
FIG. 3 illustrates a third exemplary production zone isolation system in accordance with an embodiment described herein.

FIG. 3 illustrates a third exemplary embodiment which is also operated generally as described with respect to FIG. 1 (and FIG. 2), but is, again, slightly different in structure in a number of ways. First, well 10 includes a well liner 50, with perforations (or slots) 52 therein. Additionally, the first inner tubular 32 includes other expanders 39 at various intervals along the length of the first inner tubular 32 in addition to expanders 38. Accordingly, when the refrigerant or cooling agent 40 is pumped into the first inner tubular, it exits out of the expanders 38 and 39 into regions 42 and 43 of second outer tubular 34 and at the pressurized water filled regions of the well 10 that are adjacent to the regions 42 and 43 of the second outer tubular 34, freezing is induced, thereby forming ice plugs 44 and a generally sealed region S therebetween. Additionally, individual ice plugs 45 are formed in the cracks 5, thereby providing additional plugging functionality directly to the source of hydrocarbons H.

Although the other expanders 39 are illustrated as being aligned directly with certain well line perforations 52 and cracks 5, this alignment is not critical and is shown for illustration purposes only. Further, for purposes of aligning or positioning the sealing mechanism within the well bore, various sensors and processes may be used and are known to those skilled in the art. Without limitation, these positioning sensors (or gauges) and processes may include one or more of: optical sensors, pressure sensors, temperature sensors and visual sensors.

Referring again to each of FIGS. 1 through 3, the ice plugs may be retrieved and the sealed regions removed using a thawing process, whereby a heating agent is pumped into the first inner tubular 32 in the same fashion as cooling agent 40 and exits out of the expanders 38 (and 39) and into regions 42 (and 43) of second outer tubular 34. The heating agent operates to effectively melt the ice plugs. The freeze and thaw processes are repeatable along desired portions of the various production zones in the well bore. Individually or at multiple locations at the same time. Another alternate method for thawing would be to externally heat and circulate the water in the filled wellbore causing the ice plugs to melt. Additionally, yet another thawing method would be for the heat generated by the formation to melt the ice naturally.

Exemplary heating and/or cooling agent(s) referenced herein include, but are not limited to: liquid nitrogen, liquid carbon dioxide, calcium chloride brine, or, preferably, liquid propane, steam, hot air, hot oil, chemically created exothermic reactions i.e., sodium hydroxide+$H_2O$, Calcium Oxide+$H_2O$, liquid hydrogen, liquid methane, ammonia, super cooled methanol and ethanol, helium, blast air, HFC's, and glycol/water.

Generally, with respect to the Figures, while the orientation of the wells are shown as being horizontal, it should be understood that the present embodiments are applicable to horizontal, vertical and slanted wells.

The fracturing stage of a multistage fracture and isolation process referenced above on the Background of the Embodiments may be performed by various known systems and methods including those described in U.S. Pat. No. 7,775,281 entitled METHOD AND APPARATUS FOR STIMULATING PRODUCTION FROM OIL AND GAS WELLS BY FREEZE-THAW CYCLING and pending U.S. Patent Application Publication No. 2010/0263874 entitled METHOD AND APPARATUS FOR FREEZE-THAW WELL STIMULATION USING ORIFICED REFRIGERATION TUBING, both of which are incorporate herein by reference in their entireties. This new system and method fractures the subsurface formation by freezing a water-containing zone within the formation in the vicinity of a well, thereby generating, expansive pressures which expand or created cracks and fissures in the formation. The frozen zone is then allowed to thaw. This freeze-thaw process causes rock particles in existing cracks and fissures to become dislodged and reoriented therewithin, and also causes new or additional rock particles to become disposed within both existing and newly-formed cracks and fissures. The particles present in the cracks and fissures act as natural proppants to help keep the cracks and fissures open, thereby facilitating the flow of fluids from the formation into the well after the formation has thawed. Freeze-thaw fracturing enables recovery of higher percentages of non-naturally-flowing hydrocarbons from low-permeability formations than has been possible using previously known stimulation methods.

The isolation systems described and contemplated herein may be used in conjunction with a freeze-thaw system and method and may take advantage of existing tubular components, refrigerant sources and pumps and alignment rigs as the systems and processes are based on similar concepts of using water freezing techniques—as compared to mechanical means—to facilitate the desired results. The isolation systems may be implemented in a first section of a well bore while a freeze-thaw fracturing process (or other fracturing process) and/or hydrocarbon retrieval processes are implemented at other sections of the same well bore.

It will also be appreciated by those skilled in the art that the production zone isolation systems and the methods of use described herein may include other variations that are known or obvious to those skilled in the art and as such are considered to be within the scope of the embodiments.

The invention claimed is:

1. A system for isolating one or more water flooded sections of a well bore comprising:

an outer tubular and an inner tubular having an annulus formed therebetween and forming a closed system, an external surface of the outer tubular facing the one or more flooded sections of the well bore, the inner tubular having at least a first plurality of perforations formed along a first portion of the inner tubular and a second plurality of perforations formed along a second portion of the inner tubular, the first and second portions if the inner tubular being located fore and aft of the one or more flooded sections of the well bore;

a pump for supplying a cooling agent at a first end of the inner tubular, wherein during operation of the pump the cooling agent exits the inner tubular through the at least a first and second pluralities of perforations, enters the annulus and causes water located between the external surface of the outer tubular and a wall of the well bore to freeze and form ice plugs, thereby isolating the one or more flooded sections of the well bore from other sections of the well bore;

wherein the inner tubular further includes at least a third plurality of perforations formed along a third portion of the inner tubular, wherein during supplying of the cooling agent, at least some of the cooling agent exits the third plurality of perforations, enters the annulus and causes water located between the external surface of the outer tubular and one or more crevices in the wall of the well bore to freeze and from an additional ice plug, thereby isolating the one or more crevices from remaining flooded sections of the well bore.

2. A method for isolating one or more water flooded sections of a well bore comprising:

introducing a closed refrigeration system into the well bore, the closed refrigeration system including an outer tubular and an inner tubular having an annulus formed therebetween, wherein the inner tubular includes at least a first plurality of perforations formed along a first portion of the inner tubular and a second plurality of perforations formed along a second portion of the inner tubular;

aligning the closed refrigeration system with one or more water flooded sections of the well bore, such that the at least a first plurality of perforations are located fore of the one or more water flooded sections and the at least a second plurality of perforations are located aft of the one or more water flooded sections;

introducing a cooling agent into a first end of the inner tubular, wherein the cooling agent exits the inner tubular through the first and second pluralities of perforations, enters the annulus and causes water located between the external surface of the outer tubular and a wall of the well bore to freeze and form ice plugs, thereby isolating the one or more flooded sections of the well bore from other sections of the well bore;

further wherein the inner tubular further includes at least a third plurality of perforations formed along a third portion thereof, wherein at least some of the cooling agent exits the third plurality of perforations, enters the annulus and causes water located between the external surface of the outer tubular and one or more crevices in the wall of the well bore to freeze and form an additional ice plug, thereby isolating the crevice.

3. The method according to claim 2, further comprising:

introducing a heating agent into the first end of the inner tubular, wherein the heating agent exits the inner tubular through the at least a first plurality of perforations, enters the annulus and causes the ice plug to melt.

4. The method according to claim 2, further comprising:

introducing a heating agent into the first end of the inner tubular, wherein the heating agent exits the inner tubular through the at least a first and second plurality of perforations, enters the annulus and causes the ice plugs to melt.

5. The method according to claim 2, further comprising:

introducing a heating agent into the first end of the inner tubular, wherein the heating agent exits the inner tubular through the at least a first, second and third plurality of perforations, enters the annulus and causes the ice plugs to melt.

6. A system for treating a well bore to access and control hydrocarbon retrieval comprising:

a first set of tubulars for implementing a freeze-thaw process for stimulating one or more fractures in a wall of one or more sections of the well bore, wherein the first set of tubulars includes a first closed system including a first outer tubular having an open end and a closed end and a first inner tubular having an first open end and a second open end a first annulus formed between the first outer tubular and the first inner tubular, an external surface of the first outer tubular facing the wall of the one or more sections of the well bore, whereby introduction of at least one of a cooling and heating agent into the first open end of the first inner tubular which exits the second open end of the first inner tubular and enters the annulus causes water located adjacent to the external surface of the first outer tubular to freeze or thaw, thereby stimulating one or more fractures in a wall of one or more sections of the well bore; and a second set of tubulars for implementing a process for isolating the one or more sections of the well bore from other sections of the well bore, wherein the second set of tubulars includes a second outer tubular and a second inner tubular having a second annulus formed therebetween and forming a second closed system, an external surface of the second outer tubular facing the wall of the one or more sections of the well bore, the second inner tubular having at least a first plurality of perforations formed along a first portion of the second inner tubular and a second plurality of perforations formed along a second portion of the second inner tubular, the first and second portions of the second inner tubular being located fore and aft of the one or more sections of the well bore, whereby introduction of a cooling agent at a first end of the second inner tubular causes the cooling agent to exit the second inner tubular through the at least a first and second plurality of perforations, enter the second annulus and freeze water located between the external surface of the second outer tubular and the wall of the well bore to thereby form ice plugs and isolate the one or more sections of the well bore from other sections of the well bore.

7. The system of claim 6, wherein the process for stimulating one or more fractures in a wall of one or more sections of the well bore and the process for isolating the one or more sections of the well bore from other sections of the well bore occur simultaneously but affect different sections of the well bore.

* * * * *